US011027440B2

(12) United States Patent
Vreeland

(10) Patent No.: US 11,027,440 B2
(45) Date of Patent: Jun. 8, 2021

(54) SELF-RETRACTING KNIFE WITH REPLACEABLE BLADE

(71) Applicant: Erosion Runner, L.P., Dayton, OH (US)

(72) Inventor: Gregory M. Vreeland, Springboro, OH (US)

(73) Assignee: Erosion Runner, L.P., Dayton, OH (US)

( * ) Notice: Subject to any disclaimer, the term of this patent is extended or adjusted under 35 U.S.C. 154(b) by 14 days.

(21) Appl. No.: 16/162,807

(22) Filed: Oct. 17, 2018

(65) Prior Publication Data

US 2020/0122346 A1 Apr. 23, 2020

(51) Int. Cl.
*B26B 5/00* (2006.01)

(52) U.S. Cl.
CPC ..... *B26B 5/003* (2013.01)

(58) Field of Classification Search
CPC ..... B26B 5/003; B26B 5/001; B26B 1/08
See application file for complete search history.

(56) References Cited

U.S. PATENT DOCUMENTS 3,657,812 A * 4/1972 Lee ..... B26B 1/08 30/162
5,391,177 A * 2/1995 Schwartz ..... A61B 17/3211 30/151
7,316,070 B2 1/2008 Green
7,596,869 B2 10/2009 Berns
7,765,701 B2 * 8/2010 Okada ..... B26B 5/003 30/162
7,891,098 B2 2/2011 Parker et al.
8,201,336 B2 6/2012 De
8,839,523 B2 9/2014 Ireland et al.
8,992,554 B2 * 3/2015 Auchter ..... A61B 17/3211 606/167
8,997,358 B2 4/2015 Huang
2003/0159290 A1 * 8/2003 Berns ..... B26B 5/003 30/2
2009/0106983 A1 * 4/2009 Berns ..... B26B 5/003 30/162
2015/0013171 A1 * 1/2015 Wu ..... B26B 5/003 30/162

* cited by examiner

*Primary Examiner* — Stephen Choi
(74) *Attorney, Agent, or Firm* — Jacox, Meckstroth & Jenkins

(57) ABSTRACT

A self-retracting knife includes a housing having a forward end defining a blade aperture, and a blade carrier supports a removable knife blade and is movable within the housing from a fully extended position with the blade projecting from the blade aperture and a fully retracted position by a tension spring. An anti-retraction latch member is supported by the housing and is movable with finger pressure to a position that stops the blade carrier from fully retracting so that the knife blade is partially extended through the blade aperture. In other embodiments, the blade carrier extends through a carrier aperture at the opposite end of the housing for extending the blade carrier, and an adjustable extension limiter also extends through the carrier aperture for limiting forward movement of the blade carrier and projection of the blade through the blade aperture.

6 Claims, 8 Drawing Sheets

SELF-RETRACTING KNIFE WITH REPLACEABLE BLADE

BACKGROUND

Embodiments of the present invention relate to self-retracting utility knives with replaceable blades. Such tools are sometimes referred to as box cutters and have a housing which forms a handle, and a blade may be easily removed and replaced with another blade. If the blade breaks or becomes dull, the user may remove the blade and replace it with a new blade or flip the blade to present a new edge on the blade.

A self-retracting knife is a tool where the blade is supported by a blade carrier that retracts into the handle for safety reasons when no outside forces are acting upon the blade carrier. A self-retracting utility knife usually includes a tension spring that pulls the blade carrier into the handle to keep the blade fully retracted. Thumb or finger pressure is used to offset the force of the spring to extend the blade. When pressure is released, the blade carrier fully retracts. Precise thumb or finger positioning is required as any movement of the activating extension button adjusts the amount of blade extension. When scoring or making heavy cuts with pressure, the knife transfers all of the pressure of the cut to the activating finger or thumb that is holding the blade extended and exposed. When a user pushes the blade carrier forward with enough force to overcome the spring, the blade will extend from the handle and remain extended as long as the user exerts a force to overcome the force of the retracting spring and any force applied to the work. Thus, with traditional self-retracting knives, when the user stops exerting a force to extend the blade, the blade will retract back into the handle or housing.

SUMMARY OF THE INVENTION

A self-retracting knife of the present invention also includes a housing enclosing a blade carrier and having a blade aperture at one end. The blade carrier extends a replaceable blade through the blade aperture in a fully extended position and encloses the blade within the housing in a fully retracted position. In accordance with the invention, the housing also supports an anti-retraction member or latch bar which allows a user to select a latching or non-latching position by applying or not applying a light pressure to the anti-retraction latch bar. The blade carrier is positioned in an extended position when the latch bar is in a latching position so that the force of the retraction spring will not retract the blade carrier. The spring returns the blade carrier to the fully retracted position when the anti-retraction latch bar is released and returns to the non-latching position.

According to one embodiment of the present invention, a self-retracting knife comprises a housing with a rear blade carrier aperture in addition to a front blade aperture. The blade carrier extends the blade through the front blade aperture in an extended position and the blade carrier extends through the rear carrier aperture in a retracted position. This embodiment may also include an extension limiter that prevents the rearward end of the carrier bar from moving past the end of the extension limiter when a force is applied to the end of the blade carrier. When the anti-retraction latch bar is in a latching position and a force is applied to extend the blade carrier, the blade carrier extends the blade only partially through the knife aperture of the knife housing.

DETAILED DESCRIPTION

According to one embodiment of the present invention, a self-retracting knife includes a blade carrier that projects through a rearward end of a housing of the knife. When a user wants to extend a blade attached to the blade carrier, the user grasps the knife, exerts a light finger pressure on an anti-retraction member or latch bar, and the user bumps or taps the blade carrier against a surface to extend the blade. The anti-retraction latch bar maintains the blade carrier and the blade in an extended position as long as the user maintains pressure on the bar. If the user releases pressure on the bar, the blade carrier will retract into the housing and project through the rearward end of the housing again. Thus, in this embodiment, a grasping and tapping action is required to extend the blade carrier and the force is applied to the blade carrier from outside the knife housing. In addition, a light grasping action is required on the latch bar to maintain the extension of the blade carrier.

Figure 1:
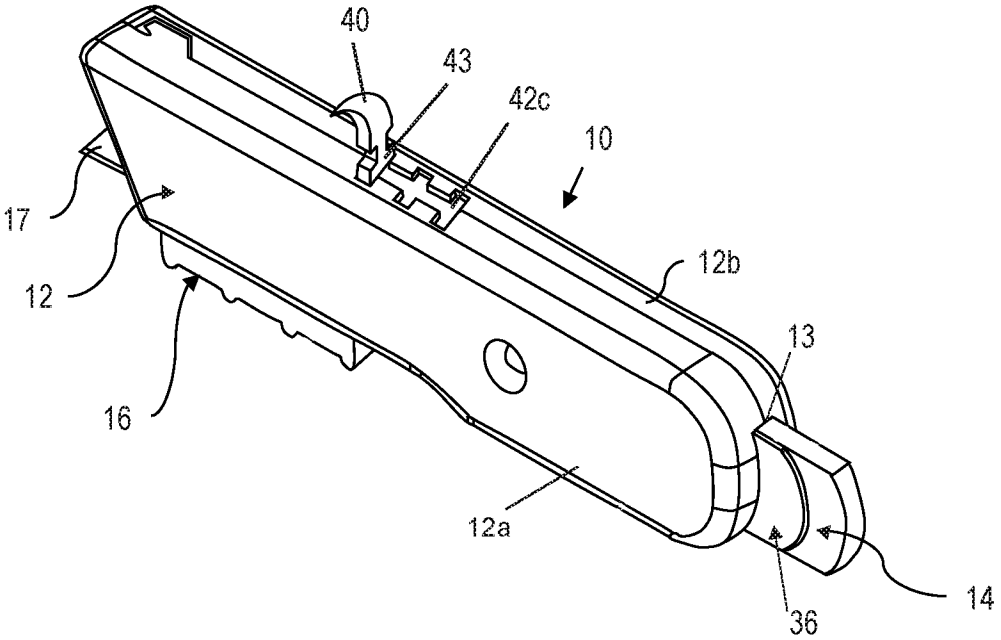
FIG. 1 is a perspective view of a self-retracting utility knife constructed in accordance with the invention.

Referring to FIG. 1, a self-retracting knife 10 includes a housing 12, a blade carrier 14, and an anti-retraction member or latch bar 16. The housing is formed by two mating housing sections 12*a* and 12*b* releasably connected in an opposing relation. However, the housing 12 may be primarily one piece or created from more than two sections. The housing 12 forms a carrier aperture 13 at the rearward end and a blade aperture 15 (FIG. 2) at opposite or front end.

The housing 12 enclosed the blade carrier 14 such that when the blade carrier 14 is in a fully retracted position, the carrier 14 projects to a maximum position through the carrier aperture 13. To extend the blade carrier 14, a user grasps the knife housing 12, applies a light finger pressure to the anti-retraction latch bar 16, and presses or taps the blade carrier 14 on a surface for example, a tabletop, the palm or leg of the user, etc. Thus, the force acting to extend the blade carrier 14 is external to the knife 10.

When the blade carrier 14 is extended, a blade 17 (FIG. 2), which is removably coupled to the blade carrier 14, extends through the blade aperture 15 of the housing 12, as shown in FIG. 1. As mentioned above, the blade 17 is removably coupled or secured to the carrier 14 such that a user may exchange a worn blade with a new blade or the opposite end of the same blade.

Figure 2:
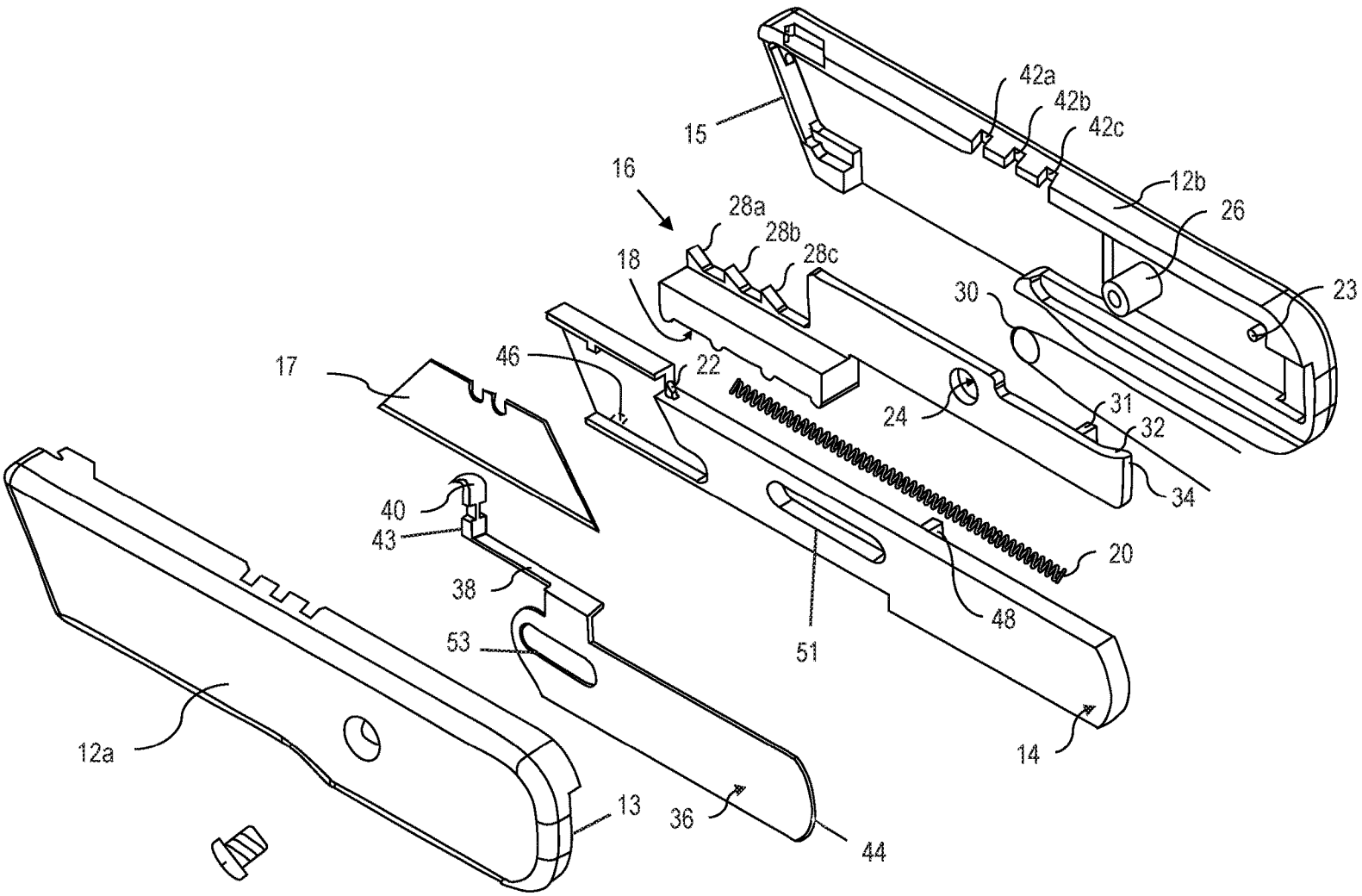
FIG. 2 is an exploded view of the self-retracting knife shown in FIG. 1.

FIG. 2 shows an exploded view of the self-retractable knife. The latch bar 16 includes a surface 18, where pressure on the surface 18 maintains the blade carrier 14 in an extended position. The housing 12 also encloses a blade carrier retraction member in the form of a tension spring 20 that connects the blade carrier 14 to the housing section 12*b* by a pin 23. The forward end of the spring 20 is connected to a hook 22 on the blade carrier bar 14. Other forms of retraction members may also be used to return the blade carrier 14 to its retracted position.

As shown in FIG. 2, the anti-retraction latch bar 16 has the surface 18 for a user to apply finger or thumb pressure to keep the blade carrier 14 in an extended position. When the user applies light pressure to the surface 18 of the latch bar 16 and the blade carrier 14 is in an extended position, one of the stop or latch teeth 28*a-c* (collectively 28) of the latch bar 16 interacts or catches with a projection or catch pin 46 (FIGS. 2 & 3) on the side of the blade carrier 14 to enter a latching position that prevents the spring 20 from returning the blade carrier 14 back to its fully retracted position. The latch teeth 28 may also be formed on the blade carrier 14 and the catch pin 46 may be formed on the latch bar 16. The self-retracting knife 10 may also have a single latch tooth and a single catch pin. In any embodiment, as long as pressure remains on the latch bar 16 and the latch bar remains in the latching position, the blade carrier 14 remains in an extended position.

The anti-retraction latch bar 16 has a hole or aperture 24 (FIG. 2) through which a tubular post 26 of the housing section 12*b* extends to support the latch bar 16 for slight rotation or pivoting. A torsion coil spring 30 couples a tab 31 on the latch bar 16 to the housing section 12*b* and rotates or pivots the latch bar 16 to a non-latching position when there is no pressure against the surface 18 of the latch bar 16.

The latch bar 16 includes an upward projection 32 that extends to an end surface 34 (FIG. 2). The blade carrier 14 has a side projection 48 (FIG. 2) that engages the projection 32 so that when the blade carrier 14 is in the fully retracted position and the latch bar 16 is in the non-latching position, the end surface 34 blocks the blade carrier 14 from being extended when a force is applied to the blade carrier 14. However, when the latch bar 16 is tilted or placed in a latching position, the end surface 34 is removed from the linear path of the projection 48 of the blade carrier 14. Thus, when the latch bar 16 is pressed to the latching position and a force greater than the force of the retraction spring 20 is applied to the blade carrier 14, the blade carrier 14 will be extended.

The self-retracing knife 10 may include an extension limiter 36 (FIG. 2) that indirectly limits how far the adjacent blade carrier 14 travels by opposing the force pushing the blade carrier 14 forward. The extension limiter 36 includes a flexible spring arm 38 with a thumb adjusting head 40 and an engaging base portion 43. The housing 12 includes three notches 42*a-c* (collectively 42), where each notch represents a different position for the extension limiter 36. For example, if the base portion 43 of the extension limiter 36 is in the left-most notch 42*a*, the blade carrier 14 will be able to travel to the fully extended position when light pressure is applied to the latch bar 16 and a force is applied to the end surface of the blade carrier 14. However, if the base portion 43 of the extension limiter 36 is in the right-most notch 42*c*, then the blade carrier 14 will only travel a short distance when pressure is applied to the latch bar 16 and a force is applied to the blade carrier 14.

To move the extension limiter 36 from one notch 42*a* to another notch 42*b* or *c*, the user presses down on the head 40 such that a base portion 43 of the head 40 is retracted into the housing 12. Then the user slides the head 40 back to the desired notch 42*b-c*. When the user releases the head 40, the spring arm 38 forces the base portion 43 into the desired notch 42, placing the extension limiter 36 in a locked position.

An end surface 44 (FIG. 2) of the extension limiter 36 projects through the carrier aperture 13, but not as far as the blade carrier 14 (FIG. 1) when the carrier 14 is in the fully retracted position. When a force is applied to the blade carrier 14, the blade carrier may slide through the housing. If the extension limiter 36 is in notch 42*b* or 42*c* and the rearward end of the blade carrier 14 reaches the end surface 44 of the extension limiter 36, the extension limiter 36 blocks further forward movement of the blade carrier 14. Thus, by using the extension limiter 36, the user can adjust how far the blade carrier 14 travels when the user presses on the latch bar 16 and applies a force to the end of the blade carrier 14. The extension limiter 36 may be used to limit how far the blade 17 attached to the blade carrier 14 will extend through the blade aperture 15.

Figure 3:
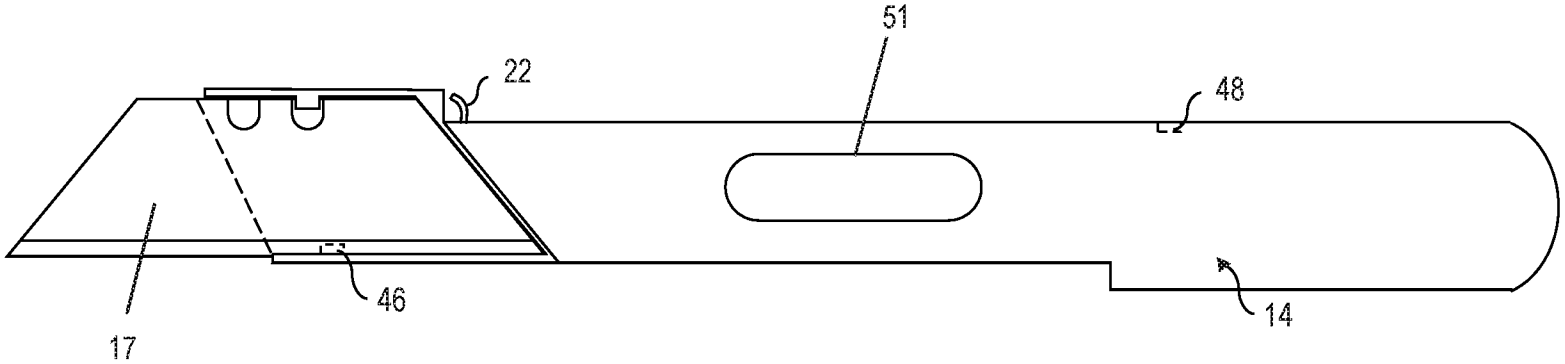
FIG. 3 is an elevational view of the blade carrier shown in FIG. 2.

FIG. 3 shows a side view of the blade carrier 14. The carrier 14 includes a hook 22 that receives one end of the retraction spring 20 (FIG. 2). The opposite end of the spring connects to the stud or pin 23 (FIG. 2). A catch pin 46 on the blade carrier 14 interacts with the retraction latch teeth 28 (FIG. 2) of the latch bar 16 to prevent or stop the retraction spring 20 (FIG. 2) from returning the blade carrier 14 back to the fully retracted position. The blade carrier 14 also includes a projection 48 (FIG. 2) that interacts with the end surface 34 (FIG. 2) so that when the self-retracting knife is in the fully retracted position and the latch bar 16 (FIG. 2) is in the non-latching position, the end surface 34 (FIG. 2) of the latch bar will prevent the blade carrier 14 from being extended even when a force is applied to the blade carrier 14. The blade carrier 14 has a slot 51 and the extension limiter 36 has a slot 53 (FIG. 2) through which the tubular post 26 (FIG. 2) projects to align the blade carrier 14, the latch bar 16, and the extension limiter 36.

Figure 4:
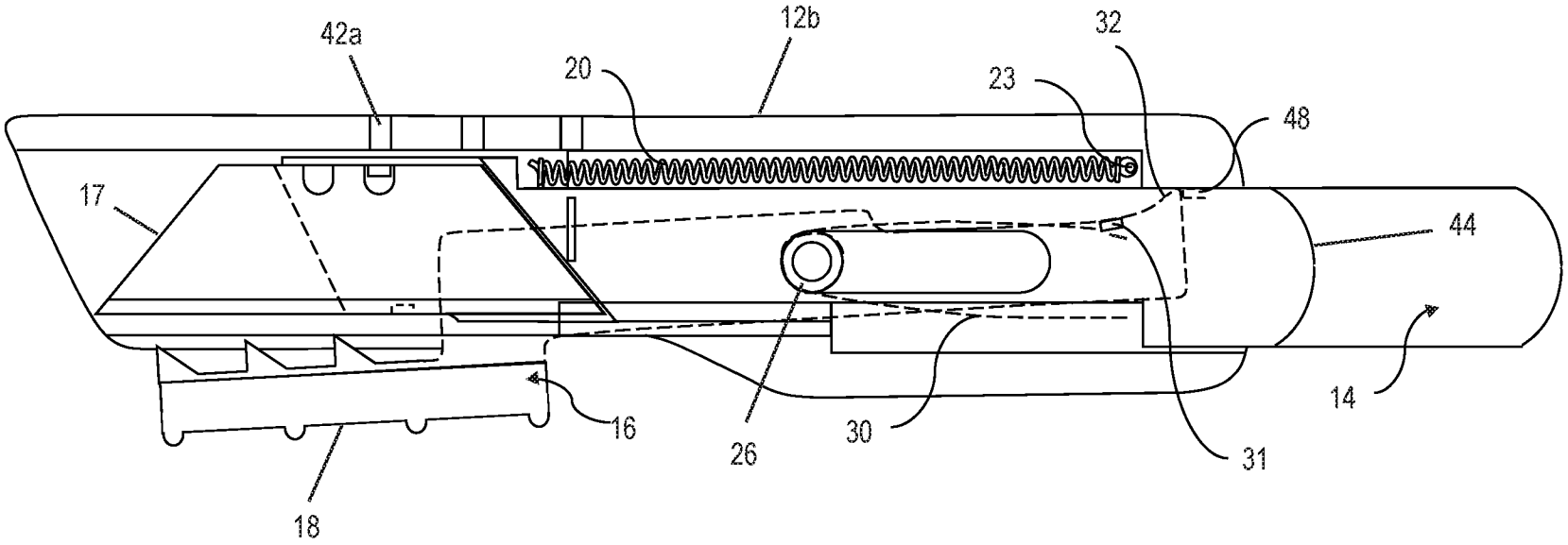
FIG. 4 is a longitudinally center view of the knife with the blade carrier in a fully retracted and non-latched position.

FIG. 4 illustrates the self-retracting knife 10 in a non-latching and retracted position with the end surface 44 of the extension limiter 36 projecting from the housing. This is the position that the self-retracting knife 10 is when no outside forces are placed on the self-retracting knife. The knife 10 is in the non-latching position because the latch bar 16 is rotated downwardly by the torsion spring 30 pressing upwardly on the tab 31 of the latch bar 16. Also, the knife 10 is in the fully retracted position with the blade carrier 14 retracted by the retraction spring 20. When the knife 10 is in the non-latching and retracted position, the projecting stub 32 is rotated upwardly into the path of the side projection 48 of the blade carrier 14 so that forward movement of the blade carrier 14 is blocked. However, when the knife 10 does not include a stub 32 or a projection 48 or both, the knife 10 can be placed in the extended position if a force is applied to the blade carrier 14 regardless of the position of the latch bar 16.

Figure 5:
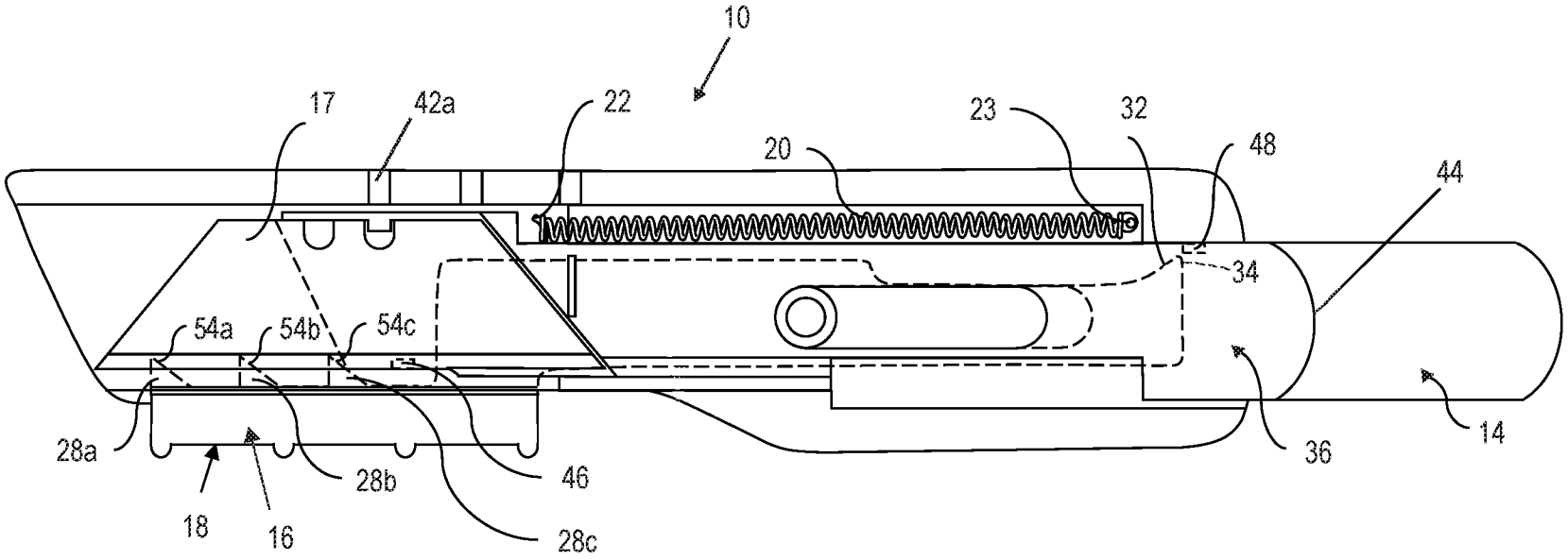
FIG. 5 is a view similar to FIG. 4 with the addition of a blade in the retracted and latched position.

FIG. 5 illustrates the knife 10 in a fully retracted position when a light force is applied to the surface 18 of the latch bar 16 but no force has been applied to the blade carrier 14. When a force, such as finger pressure on the surface 18 from a user gripping the knife 10, of the latch bar 16 rotates the projection 32 and end surface 34 (FIG. 2) out of the way of the projection 48 so that a force applied to the blade carrier 14 will cause the blade carrier to travel such that the blade 17 extends through blade aperture 15 (FIG. 2). As the catch pin 46 of the blade carrier 14 slides past the retraction latch teeth 28*a-c*, the catch pin 46 slides up inclined surfaces 54*a-c* of the latch teeth 28*a-c* to move the latch teeth 28*a-c* out of the way of the catch pin 46 of the blade carrier 14.

Thus, the blade carrier 14 repeatably tilts the latch bar 16 out of the way while the blade carrier 14 travels through the housing 2. However, if the user grips the latch bar 16 with greater pressure or force, then the latch teeth 28*a-c* will not move out of the way. Thus, a user should not apply too much pressure to the latch bar 16 while blade carrier 14 is traveling.

In embodiments that include an extension limiter 36 as shown in FIGS. 2 and 5, the end surface 44 will limit the travel of the blade carrier 14, depending on where the extension limiter is set. In the example of FIG. 5, the extension limiter is in the leftmost notch 42*a* of FIG. 2, so the blade carrier 14 can travel the entire distance to the fully extended position where the blade 17 projects fully out of the blade aperture 15. However, when the extension limiter is in the middle notch 42*b*, then the blade carrier 14 produces a medium extension of the blade 17 out of the blade aperture 15. Further, if the extension limiter 36 were in the rightmost notch 42*c*, the blade carrier 14 would travel less than when the extension limiter is in the middle notch, resulting in a short extension of the blade 17 out of the blade aperture 15.

Figure 6:
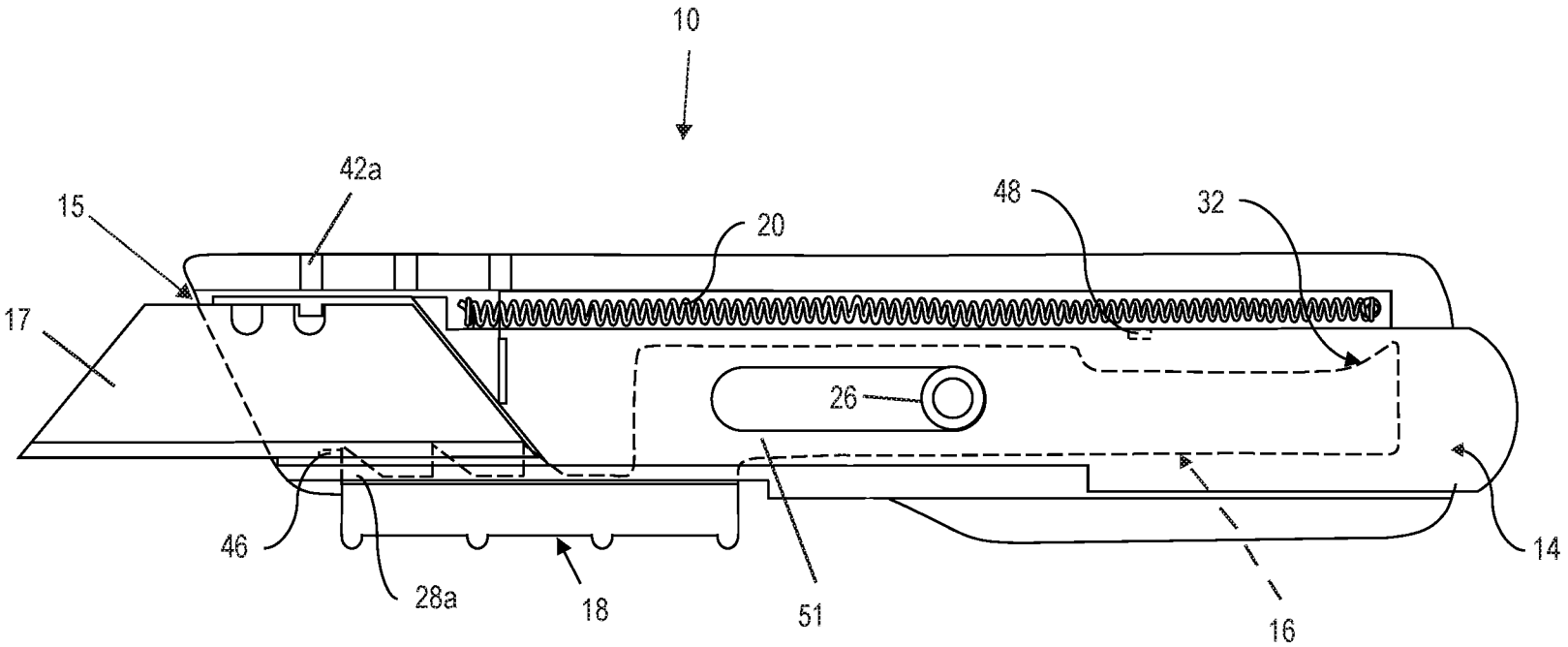
FIG. 6 is a view similar to FIG. 5 and with blade in its fully extended and latched position.

FIG. 6 illustrates the knife 10 in a latched and fully extended position. With pressure on the surface 18 of the latch bar 16, a force previously applied to the blade carrier 14 resulting in the blade carrier 14 in the fully extended position, the latch teeth 28 interacts with the catch pin 46 of the blade carrier 14 and prevent the retraction spring 20 from retracting the blade carrier 14. Thus, the knife 10 remains with the blade 17 in the fully extended position.

When pressure is removed from the latch bar 16, the retraction latch teeth 28 are no longer engaged with the catch pin 46 of the blade carrier 14, and the retraction spring 20 returns the blade carrier 14 to the fully retracted position of FIG. 4. As the blade carrier 14 returns to the retracted position, the projection 48 of the blade carrier 14 slides along the top surface of the latch bar 16, which pivots the latch bar 16 out of the way, so the blade carrier 14 may return to the fully retracted position of FIG. 4. Once the projection 48 of the blade carrier 14 is clear of the latch bar 16, the spring 30 returns the latch bar 16 to its home position shown in FIG. 4.

Figure 7:
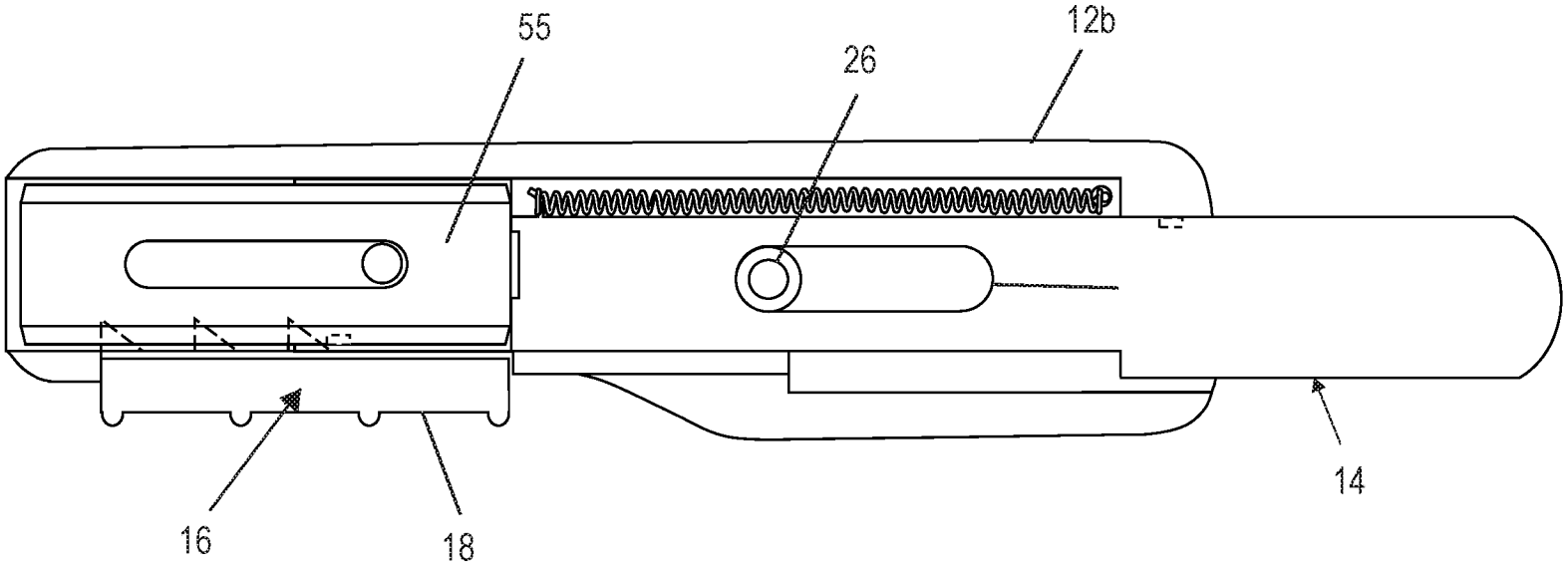
FIG. 7 is a view similar to FIG. 6 and showing a two edge blade in a fully retracted and latched position.

As shown in the embodiments of FIGS. 1-6, the self-retracting knife 10 is a utility knife. However, the self-retracting knife may be any type of knife that includes a removable blade from a blade carrier. For example, the self-retracting knife 10 may be made as a carpet knife as shown in FIG. 7. All of the structural components of this self-retracting knife would be similar to the structural components of the embodiments described above except for a two or double edge blade 55.

Figure 8:
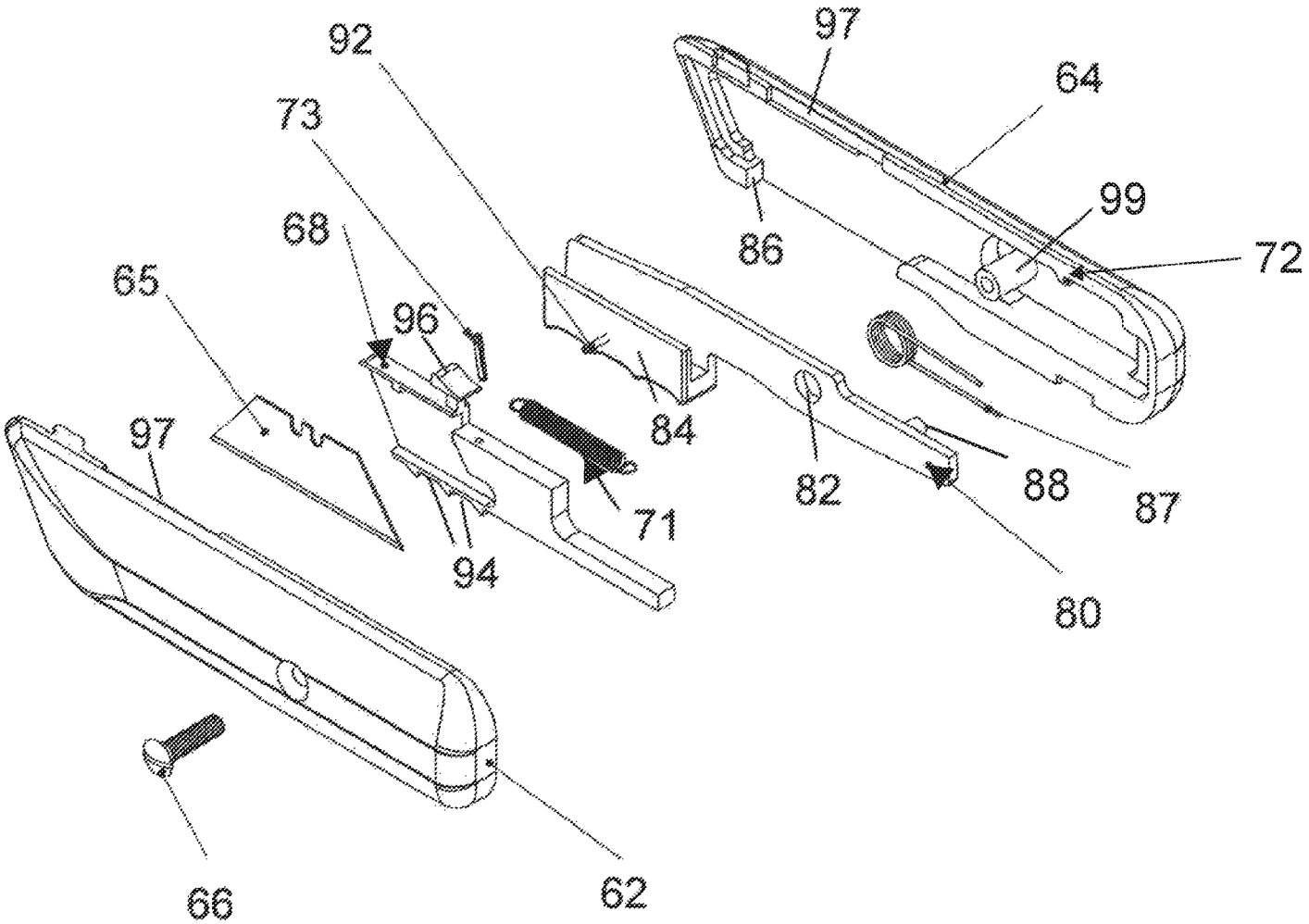
FIG. 8 is an exploded view of a modified self-retracting knife constructed in accordance with the invention.

FIG. 8 illustrates a modified and simpler form of a self-retracting knife constructed in accordance with the invention and operates in a manner similar to the knife of FIGS. 1-6. The modified knife includes an elongated housing formed by mating housing shells or sections 62 and 64 of die-cast metal or molded plastics material and which are secured together by a screw 66 threaded into a tubular boss 99 molded as a part of the housing section 64. A conventional knife blade 65 is supported within the housing by a blade carrier 68 which slides within the housing between a fully retracted position where the blade carrier 68 and blade 65 are enclosed within the housing and a fully extended position where the blade 65 projects through a slot formed within the forward end of the housing sections 62 and 64.

A biasing or retraction member in the form of a retraction tension spring 71 has a forward end portion connected to the carrier 68 by a pin 73 pressed into a hole within the top surface of the blade carrier 68. The spring 71 has a rearward end portion connected to a hook 72 formed as part of the housing section 64. In accordance with this modification of the invention, an anti-retraction member or latch bar 80 is pivotally supported within the housing by the tubular boss 99 which projects through a hole 82 within the latch bar 80. The latch bar 80 has a forward finger engaging portion 84 which projects downwardly through a slot 86 formed within the bottom of the housing sections 62 and 64. The finger engaging portion 84 is biased downwardly within the slot 86 by a coil spring 87 having one end portion interacting with the housing section 64 and an opposite end portion interacting to a side projection 88 of the latch bar 80. The latch bar 80 has a pin 92 which projects laterally and is positioned to engage one of the surfaces formed by teeth 94 on the bottom of the blade carrier 68 when the forward portion 84 of the latch bar 80 is pressed upwardly by fingers pressing on the bottom surface of the forward portion 84.

The use and operation of the self-retracting knife shown in FIG. 8 is similar to the knife described above in connection with FIGS. 1-6. That is, the blade will not retract while pressure is maintained on the latch bar 80. It differs in how the blade 65 is extended. The blade is extended by moving the thumb engaging button 96 forward which is connected to the blade carrier 68 which slides through the slot 97. The blade is extended by exerting a force on the thumb button 96 that is sufficient to extend or stretch the tension spring 71. The blade may be held by the thumb button 96 in the extended position against the tension of the return spring and the force of the knife blade on the work surface or can also be held in position with pressure on the surface of the latch bar 80. If it is desired to only partially extend the blade through the housing, the thumb button should only be advanced far enough for the pin 92 to engage the tooth 94 which provides the desired amount of extension. Two or more partially extended positions for the knife blade 65 may be obtained by two or more teeth 94 with stop surfaces formed on the bottom of the blade carrier 68.

It is apparent that a self-retracting knife constructed in accordance with the invention provides desirable features and advantages. For example, in reference to the embodiment of FIG. 8, not only is the knife blade 65 self-retracting to a fully retracted position within the housing, which is desired by many users, the knife blade may be held in a fully extended position or a partially extended position by only extending the blade carrier 68 to a partially or fully extended position. In the event it is not desired or possible to hold the thumb button 96, the blade carrier 68 may be held in place simply pressing upwardly with light finger pressure on the forward end portion 84 of the latch bar 80 so that the pin 92 engages one of the stop surfaces on the teeth 94. If the light finger pressure on the forward portion of the latch bar 80 is released, the coil spring 87 returns the latch bar 80 to its home position and the retraction spring 71 returns the blade and blade carrier to its fully retracted position within the housing. This permits the knife to be used in any position as long as the user's fingers are pressing on the forward portion of the latch bar 80.

In the self-retracting knife described in FIGS. 1-8, the blade will remain exposed from the housing the desired amount while allowing the fingers or thumb to be adjusted, moved, relocated, or repositioned on the knife as long as slight pressure is maintained on the anti-retraction latch bar. Also, when scoring or making heavy cuts with the knife using pressure, the forces are transferred to the entire hand as only a slight amount of pressure is needed on the anti-retraction latch bar to keep the blade extended to its desired position. This avoids placing those forces on the activating finger or thumb.

As another advantage, it is easier and faster to extend the blade by bumping or tapping the rearward end of the knife on a surface (table top, wall, the users leg) than it is to pick up the knife, position a finger or thumb over the activation button, and slide it forward to expose the blade. A further advantage is provided by the preset extension stops on a knife of the present invention makes it easier to use the knife with the blade partially exposed. For example, when opening a closed cardboard box, the user would like to expose the blade enough to cut the tape but not so much as to damage the contents. Prior self-retracting knives allow for partial extension, but any movement of the activating button will adjust the blade exposure, risking the contents of the box. In comparison, the extension limiter of the invention allows the user to preset the blade to a certain depth, removing risk of damage to the contents.

While the forms of knives herein described constitute preferred embodiments of the invention, it is to be understood that the invention is not limited to these precise forms of knives, and that changes may be made therein without departing from the scope of the invention as defined in the appended claims.

What is claimed is:

1. A self-retracting utility knife comprising an elongated housing having mating sections connected together and with a forward end portion defining a blade aperture, a blade carrier within the housing and having a forward end portion supporting a replaceable flat knife blade, the housing supporting the blade carrier for linear movement between a fully extended position with the knife blade projecting forwardly from the blade aperture and a fully retracted position with the knife blade in the housing, a spring member within the housing and connected to urge the blade carrier and knife blade continuously from the fully extended position to the fully retracted position, a hand operated member connected to the blade carrier for moving the blade carrier and knife blade against the spring member toward the fully extended position in response to forward pressure on the hand operated member, an anti-retraction latch member supported for movement within the housing and responsive to continuous inward pressure for engaging and stopping retracting movement of the blade carrier at an extended position from the fully retracted position, the latch member requiring continuous inward pressure to hold the blade carrier at the extended position, the blade carrier and knife blade move to the fully retracted position by the spring member when the inward pressure on the latch member is released, and the anti-retraction latch member includes a plurality of stop surfaces for stopping retraction of the knife carrier and knife blade at a plurality of positions spaced inwardly from the fully extended position.

2. A self-retracting utility knife comprising an elongated housing having mating sections connected together and with a forward end portion defining a blade aperture, a blade carrier within the housing and having a forward end portion supporting a replaceable flat knife blade, the housing supporting the blade carrier for linear movement between a fully extended position with the knife blade projecting forwardly from the blade aperture and a fully retracted position with the knife blade in the housing, a spring member within the housing and connected to urge the blade carrier and knife blade continuously from the fully extended position to the fully retracted position, a hand operated member connected to the blade carrier for moving the blade carrier and knife blade against the spring member toward the fully extended position in response to forward pressure on the hand operated member, an anti-retraction latch member supported for movement within the housing and responsive to continuous inward pressure for engaging and stopping retracting movement of the blade carrier at an extended position from the fully retracted position, the latch member requiring continuous inward pressure to hold the blade carrier at the extended position, the blade carrier and knife blade move to the fully retracted position by the spring member when the inward pressure on the latch member is released, and the anti-retraction latch member is biased downwardly through an opening within a lower portion of the housing and is adapted to receive upward pressure for moving the latch member.

3. A self-retracting utility knife comprising an elongated housing having mating sections connected together and with a forward end portion defining a blade aperture and a rearward end portion defining a blade carrier aperture, an elongated blade carrier within the housing and having a forward end portion supporting a replaceable flat knife blade and a rearward end portion, the housing supporting the blade carrier for linear movement between a fully extended position with the knife blade projecting forwardly from the blade aperture and a fully retracted position with the rearward end portion of the blade carrier projecting rearwardly from the blade carrier aperture, a first spring member within the housing and connected to urge the blade carrier and knife blade continuously from the fully extended position to the fully retracted position, the blade carrier and knife blade movable against the first spring member toward the fully extended position in response to forward pressure on the projecting rearward end portion of the blade carrier, an anti-retraction latch member supported for movement within the housing against a second spring member and responsive to continuous inward pressure for engaging and stopping retracting movement of the blade carrier at an extended position from the fully retracted position, the latch member requiring continuous pressure against the second spring member to hold the blade carrier at the extended position, the blade carrier and knife blade move to the fully retracted position by the first spring member when both forward pressure on the blade carrier and the inward pressure on the latch member are released, and a blocking member engaging the blade carrier for preventing movement of the blade carrier and knife blade from the fully retracted position toward the fully extended position until the blocking member is removed from engagement with the blade carrier.

4. A self-retracting utility knife comprising an elongated housing having mating sections connected together and with a forward end portion defining a blade aperture and a rearward end portion defining a blade carrier aperture, an elongated blade carrier within the housing and having a forward end portion supporting a replaceable flat knife blade and a rearward end portion, the housing supporting the blade carrier for linear movement between a fully extended position with the knife blade projecting forwardly from the blade aperture and a fully retracted position with the rearward end portion of the blade carrier projecting rearwardly from the blade carrier aperture, a first spring member within the housing and connected to urge the blade carrier and knife blade continuously from the fully extended position to the fully retracted position, the blade carrier and knife blade movable against the first spring member toward the fully extended position in response to forward pressure on the projecting rearward end portion of the blade carrier, an anti-retraction latch member supported for movement within the housing against a second spring member and responsive to continuous inward pressure for engaging and stopping retracting movement of the blade carrier at an extended position from the fully retracted position, the latch member requiring continuous pressure against the second spring member to hold the blade carrier at the extended position, the blade carrier and knife blade move to the fully retracted position by the first spring member when both forward pressure on the blade carrier and the inward pressure on the latch member are released, and the anti-retraction latch member includes a plurality of stop surfaces for stopping retraction of the knife carrier and knife blade at a plurality of positions spaced inwardly from the fully extended position.

5. The knife of claim 4 and including a blade extension limiter supported within the housing and projecting rearwardly through the blade carrier aperture adjacent the blade carrier, and the extension limiter including a portion adjustably connected to the housing for opposing the force on the blade carrier toward the fully extended position.

6. A self-retracting utility knife comprising an elongated housing having mating sections connected together and with a forward end portion defining a blade aperture and a rearward end portion defining a blade carrier aperture, an elongated blade carrier within the housing and having a forward end portion supporting a replaceable flat knife blade and a rearward end portion, the housing supporting the blade carrier for linear movement between a fully extended position with the knife blade projecting forwardly from the blade aperture and a fully retracted position with the rearward end portion of the blade carrier projecting rearwardly from the blade carrier aperture, a first spring member within the housing and connected to urge the blade carrier and knife blade continuously from the fully extended position to the fully retracted position, the blade carrier and knife blade movable against the first spring member toward the fully extended position in response to forward pressure on the projecting rearward end portion of the blade carrier, an anti-retraction latch member supported for movement within the housing against a second spring member and responsive to continuous inward pressure for engaging and stopping retracting movement of the blade carrier at an extended position from the fully retracted position, the latch member requiring continuous pressure against the second spring member to hold the blade carrier at the extended position, the blade carrier and knife blade move to the fully retracted position by the first spring member when both forward pressure on the blade carrier and the inward pressure on the latch member are released, and the anti-retraction latch member is biased downwardly through an opening within a lower portion of the housing and is adapted to receive upward pressure for moving the latch member.

* * * * *